United States Patent [19]

Briddell et al.

[11] Patent Number: 5,000,361

[45] Date of Patent: Mar. 19, 1991

[54] CAULKING GUN NOZZLE

[75] Inventors: Brian J. Briddell, Jackson; Philip D. Beery, Brooklyn, both of Mich.

[73] Assignee: Adco Products Inc., Michigan Center, Mich.

[21] Appl. No.: 88,735

[22] Filed: Aug. 24, 1987

[51] Int. Cl.[5] ..... B05C 5/02

[52] U.S. Cl. ..... 222/575; 401/48; 401/193; 401/266

[58] Field of Search ..... 222/191, 192, 566, 567, 222/570, 575, 325–327; 401/261, 265, 266, 193, 139, 48; 425/458, 87

[56] References Cited

U.S. PATENT DOCUMENTS

| | | | |
|---|---|---|---|
| 2,321,333 | 6/1943 | Terry | 401/266 X |
| 2,754,033 | 7/1956 | Etter | 222/326 |
| 2,953,285 | 9/1960 | McKelvey | 222/325 X |
| 3,087,654 | 4/1963 | Moore | 222/575 X |
| 3,090,071 | 5/1963 | LeBrooy | 401/266 |
| 3,099,582 | 7/1963 | Ongstad et al. | 401/266 |
| 3,255,937 | 6/1966 | Jarrett | 222/575 X |
| 3,279,971 | 10/1966 | Gardener | 222/567 X |
| 3,594,089 | 7/1971 | Powell et al. | 401/266 X |
| 3,653,560 | 4/1972 | Adams et al. | 401/266 X |
| 4,592,495 | 6/1986 | Toda et al. | 222/526 |
| 4,682,950 | 7/1987 | Dragan | 222/575 X |
| 4,872,778 | 10/1989 | Longo | 401/48 X |

*Primary Examiner*—Kevin P. Shaver

*Attorney, Agent, or Firm*—Donald G. Epple; Anthony L. Cupoli

[57] ABSTRACT

The invention is a caulking gun nozzle attachment for consistently applying sealant at a roofing material overlap. The attachment includes a female end for matingly engaging a caulking gun nozzle; an applicator end in communication therewith; the applicator end having a coat-hanger shaped opening defined by a convex upper surface, and a lower surface which are joined at a first edge in a spaced-apart second edge; and a vertical solid guide intermediate the first and the second edge for tracking the overlap whereby a sealant is applied at the overlap uniformly an equal distance therefrom.

1 Claim, 4 Drawing Sheets

CAULKING GUN NOZZLE

FIELD OF THE INVENTION

The invention is in the field of sealant applicators for roofing material overlap.

BACKGROUND OF THE INVENTION

Sheets of roofing material are laid on a roof in an overlap fashion. To prevent that material from separating, as well as, to seal the overlap from intrusion of moisture and other matter, a sealant is placed on the material at the overlap.

In the roofing industry, the practice has been to apply the sealant with a blade. Although, the blade is useful in spreading the sealant, it does not do so in a uniform fashion.

If the angle of the blade is small, excessive sealant is removed, resulting in too low a sealant thickness.

It is an object of the invention to provide a sealant applicator which permits application and spreading of roofing sealant in a uniform fashion about the overlap seam of roofing material.

SUMMARY OF THE INVENTION

The invention is a caulking gun nozzle gun attachment for consistently applying sealant at a roofing material overlap. The attachment includes a female end for matingly engaging a caulking gun nozzle; an applicator end in communication therewith; the applicator end having an opening defined by an upper surface, and a lower surface which are joined at a first edge and a spaced apart second edge; and a guide intermediate said first and said second edge for tracking said overlap whereby sealant is applied at the overlap uniformly and equidistant therefrom.

In a preferred embodiment, the applicator end is shaped like a duckbill with upper and lower bills being parallel to each other, and with the upper bill being convex.

DESCRIPTION OF THE PREFERRED EMBODIMENTS

Figure 1:
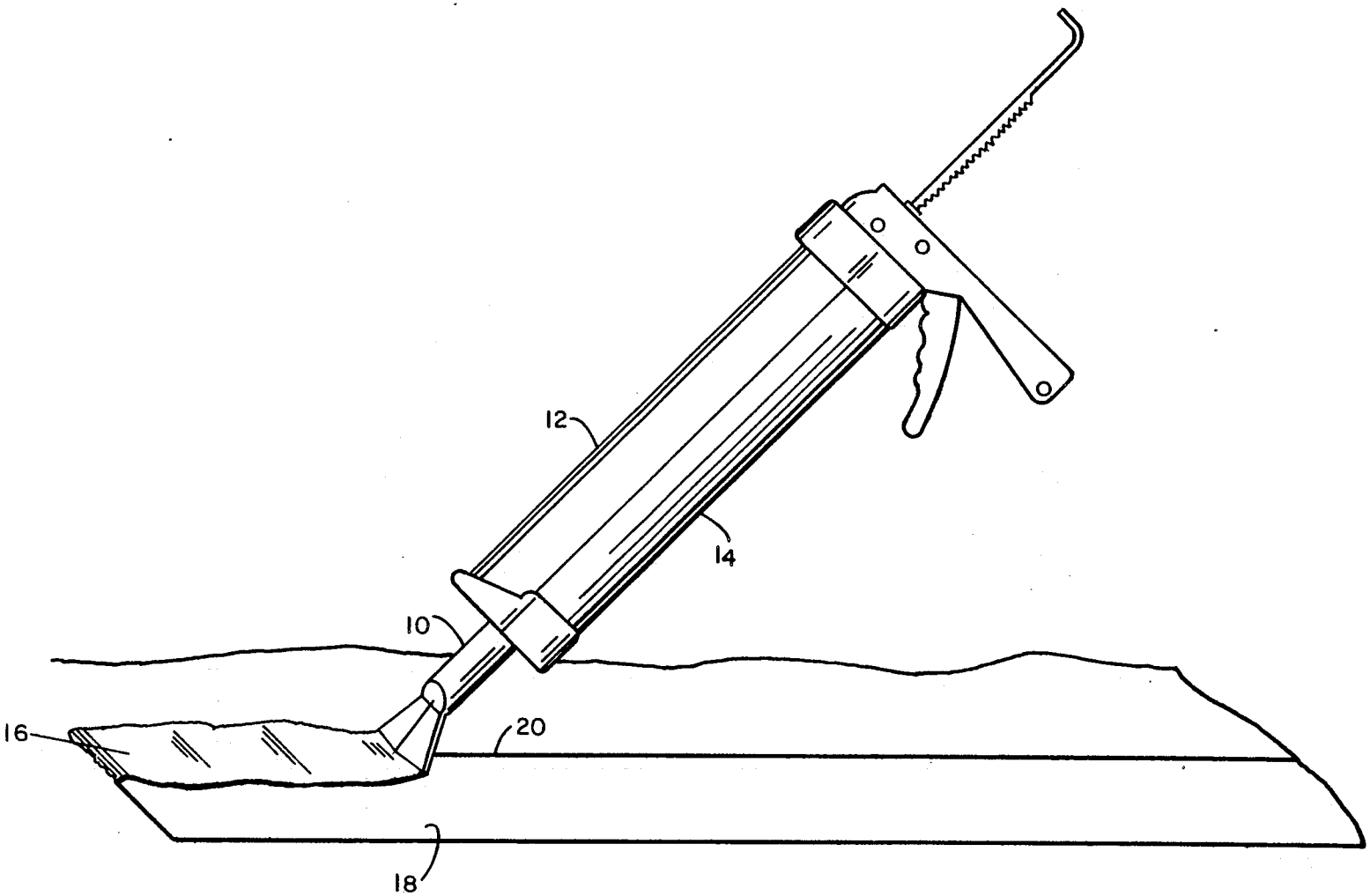
FIG. 1 is an isometric view of an embodiment of the invention.

The invention is a caulking gun nozzle attachment for a applying sealant to a rubberized roofing material. This roofing material is of the type generally used in flat commercial roofing. Because the roofing material comes in sheets which are not large enough to cover an entire roof, the material must be overlapped. At the point of overlap, a bead of sealing material must be applied thereto.

In the preferred embodiment, the caulking gun nozzle attachment 10 is affixed to a caulking tube 12 and placed in a caulking gun 14, the caulking gun 14 is used to squeeze caulking through the nozzle for applying a uniform strip of sealant 16 to roofing material 18 at the overlap 20.

Figure 2:
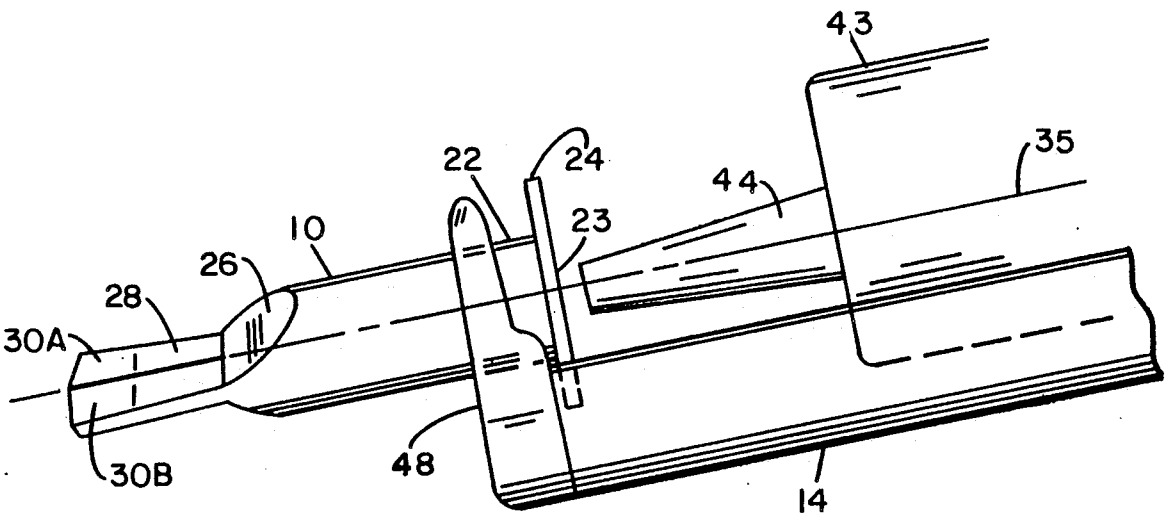
FIG. 2 is an exploded view of the embodiment of the invention depicted in FIG. 1.

As depicted in FIG. 2, the nozzle 10 has a female end 22 which is substantially cylindrical and has end opening 23. Annular ring 24 is at end 22 near opening 23.

Attachment 10 has a tapered mid-section 26 opposing annular ring 24. Tapered mid-section 26 extends to duckbill applicator end 28. Said duckbill applicator end 28 has a convex upper surface 29 extending forwards of tapered mid-section 26. Upper surface 29 is defined by first surface 30A and second surface 30B which meet at a form peak 31.

Figure 3:
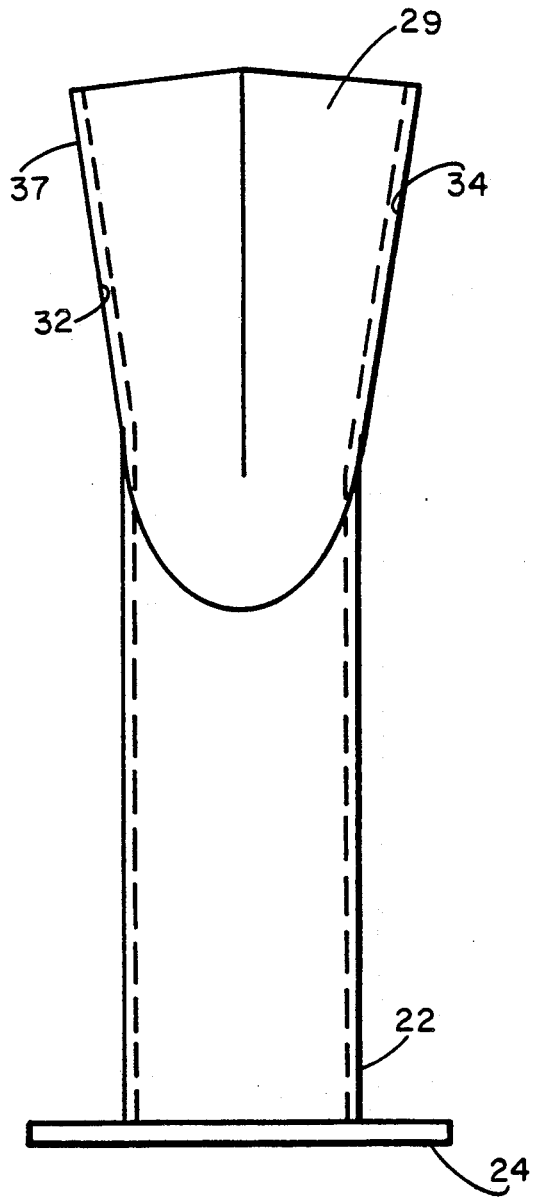
FIG. 3 is a front view of the embodiment of the invention depicted in FIG. 2.

As depicted in FIG. 3, upper surface 29 is parallel to and in registration with lower surface 37 and joined thereto by first edge 32 and edge 34. Moreover a central axis 35 passes longitudinally through the length of nozzle 10.

The caulking tube has tip 44. The caulking gun has forward wall 48 having an opening for receiving nozzle 10.

Figure 4:
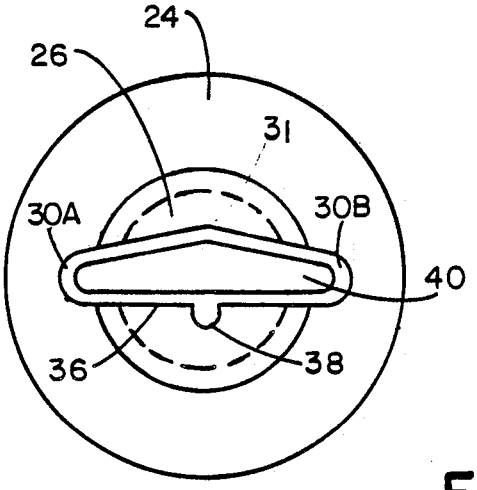
FIG. 4 is a plan view of the embodiment of an invention depicted in FIG. 3.

FIG. 4 provides a plan view of an embodiment of the invention. Provided therein are first surface 30A, second surface 30B, Peak 31, lower surface guide 38, tapered mid-section 26, annular ring 24 and the applicator opening 40, through which the sealant material is extruded for appliCation to roofing overlap 20.

Figure 5:
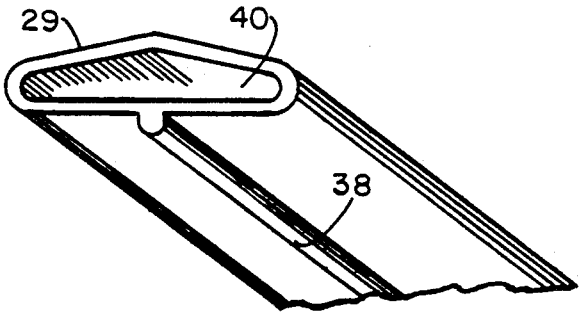
FIG. 5 is a fragmented perspective view of the embodiment of the invention depicted in FIG. 4.
Figure 6:
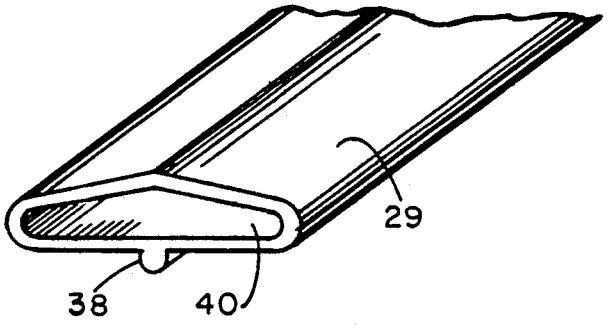
FIG. 6 is a fragmented perspective view of the embodiment of the invention depicted in FIG. 3.

The fragmented views of FIG. 5 and FIG. 6 depicts a duckbill applicator end 28 showing applicator opening at 40, lower surface guide 38, Peak 31 and upper surface 29 and how Peak 31 is directly opposite the low surface guide 38.

In practice, the applicator 10 is inserted through the forward wall of the caulking gun 48. Then the caulking gun nozzle 44 inserted through the annular ring 24 and into female end 22 in a mating fashion.

The sealant material is squeezed from caulking tube 12 using the caulking gun 14 in normal fashiOn. This sealant passes through the tapered mid-section 26 and is continually compressed. It is extruded through applicator opening 40 and applied to the overlap seam of roofing material. Lower surface guide 38 is abutted against the overlap edge 20 with central axis 42 parallel to said edge 20. The entire apparatus including applicator attachment 18, caulking tube 12 and caulking gun 14 is pulled along the edge leaving a trail of sealant behind. All the time, the lower guide 38 is in contact with said overlap 20.

It has been found that in this manner, a uniform application of sealant is possible. Moreover, the sealant at the overlap is more uniform than has been possible using already existing applicators.

Although, the flat lower surface 37 of the duckbilled application end 28 is believed to result in a flat even flow, it is also believed that surface guide 38 enhances the eveness of flow by its central location along the axis of application.

Surface guide 38 does not have to be deep. A length of even 1 mm is enough to provide necessary tracking. In this position upper peak 31 can be used to sight appropriate path for laying down the sealant. Thus peak 31 and lower surface guide 38 can be used in conjunction with each.

The pucker of the upper bill to form Peak 31 provides additional sealant at the point of overlap 20 of roofing material 18. This prevents formation of a depression caused by the differing heights of the overlapped roofing material 18 at the point of overlap and has the advantage of providing additional sealant where it is most needed.

Having described our invention, we claim:

1. A caulking gun nozzle attachment for spreadingly applying sealant at a roofing material overlap comprising;

a female end adapted to matingly engage a caulking gun nozzle;

an applicator end in communication therewith; said applicator end having a coat-hanger shaped opening of sufficient area to apply sealant onto a roofing material overlap to seal said overlap from intrusion of moisture and other matter and to provide additional sealant at the overlap;

said coat-hanger shaped opening being defined by a convex upper surface, and a lower surface which are joined at a first edge and a spread apart second edge; and a vertical solid guide on said lower surface, intermediate said first edge and said second edge and parallel thereto for engagingly tracking said overlap whereby sealant is spreadingly applied at the overlap and equidistant therefrom.

* * * * *